US005328029A

United States Patent [19]

Chow

[11] Patent Number: 5,328,029

[45] Date of Patent: Jul. 12, 1994

[54] TOOL HOLDER WITH CAVITIES FOR SOCKETS

[76] Inventor: Jessie Chow, No. 18, Hou Juan Road, Taichung, Taiwan

[21] Appl. No.: 89,938

[22] Filed: Jul. 12, 1993

[51] Int. Cl.[5] ..... B65D 85/28

[52] U.S. Cl. ..... 206/378; 206/376; 206/486

[58] Field of Search ..... 206/376-378, 206/486, 490, 804

[56] References Cited

U.S. PATENT DOCUMENTS

| | | | |
|---|---|---|---|
| 2,845,758 | 8/1958 | Lowthian | 206/486 |
| 4,253,356 | 3/1981 | Martinmaas | 206/378 |
| 4,302,990 | 12/1981 | Chrichton et al. | 206/378 |
| 4,928,821 | 5/1990 | Belko, Jr. | 206/490 |
| 4,930,628 | 6/1990 | Bridges | 206/378 |
| 5,133,455 | 7/1992 | Chow | 206/378 |
| 5,203,469 | 4/1993 | Chang et al. | 206/378 |

*Primary Examiner*—Paul T. Sewell
*Assistant Examiner*—Thomas P. Hilliard
*Attorney, Agent, or Firm*—Charles E. Baxley

[57] ABSTRACT

A tool holder includes two opposite surfaces, a number of openings formed in the tool holder for receiving tools, and one or more projections formed in the tool holder for engaging with the tools so as to retain the tools in the openings, the openings are extended through the tool holder and opened in both of the opposite surfaces such that the tools can be easily reached from either side of the tool holder.

3 Claims, 1 Drawing Sheet

TOOL HOLDER WITH CAVITIES FOR SOCKETS

BACKGROUND OF THE INVENTION

The present invention relates to a holder, and more particularly to a tool holder.

2. Description of the Prior Art

Typical tool holders, particularly the tool holders for holding sockets or wrenches, include a two part housing having a plurality of recesses formed therein for receiving the sockets and the wrenches, however, the sockets and the wrenches have only part of the outer surfaces thereof exposed, such that the sockets and the wrenches can not be easily taken out from the recesses.

The present invention has arisen to mitigate and/or obviate the afore-described disadvantages of the conventional tool holders.

SUMMARY OF THE INVENTION

The primary objective of the present invention is to provide a tool holder in which the tools received therein can be easily taken out.

In accordance with one aspect of the invention, there is provided a tool holder comprising a body including two opposite surfaces, a plurality of openings formed in the body for receiving tools, and means for engaging with the tools so as to retain the tools in the openings, the openings being extended through the body and opened in both the opposite surfaces such that the tools are reachable from either of the opposite surfaces.

The engaging means may include one or more projections extended inwards of the openings so as to engage with the tools and so as to retain the tools in the openings. Alternatively, the engaging means may include one or more recesses formed in each of the openings so as to retain the tools in the openings.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 2:
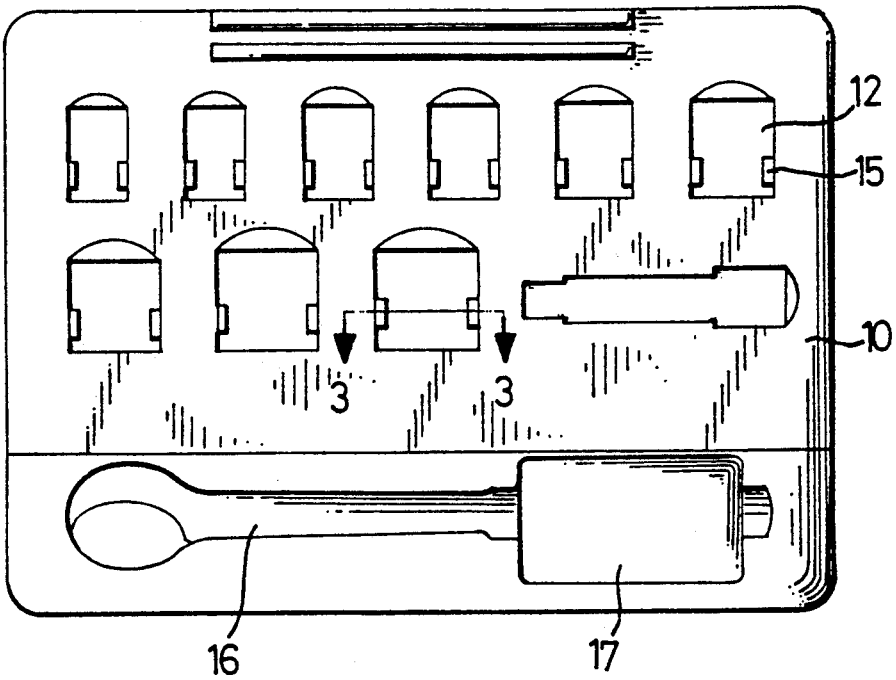
FIG. 2 is a front view of the tool holder.
Figure 3:
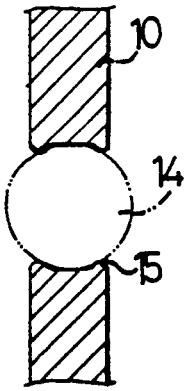
FIG. 3 is a cross sectional view taken along lines 3—3 of FIG. 2.
Figure 1:
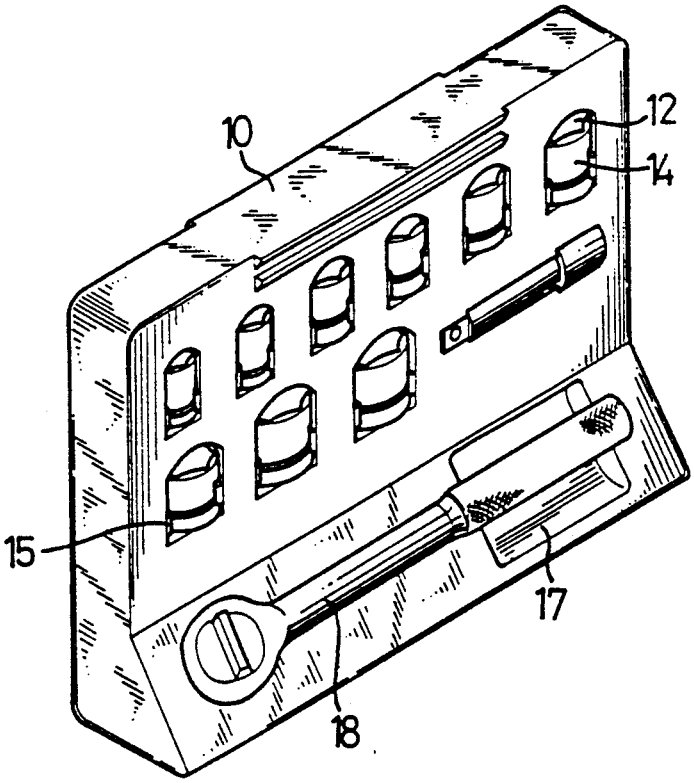
FIG. 1 is a perspective view of a tool holder in accordance with the present invention.

Referring to the drawings, a tool holder in accordance with the present invention comprises a body 10 which is substantially a plate or a board having a plurality of openings 12 formed therein for receiving the tools to be retained by the tool holder, for example, as shown in the drawings, the openings 12 are designed for receiving sockets 14 of wrenches 18, it is to be noted that the openings 12 are extended through the body 10, i.e., the openings 12 are opened in both the front surface and the rear surface of the body 10, such that the sockets 14 are reachable from both the front surface and the rear surface of the body 10, each of the openings 12 includes at least two projections 15 extended inward therefrom so as to retain the tools 14 within the openings 12, best shown in FIG. 3, or relatively, a pair of recesses are oppositely formed in each of the openings 12 for engaging with the tools 14 so as to retain the tools 14 within the openings 12.

It is preferable that a depression 16 is formed in the bottom portion of the body 10 for receiving the wrench 18, and a cavity 17 is formed in one end of the depression 16 corresponding to the handle portion of the wrench 18 such that the wrench 18 can be easily taken out from the depression 16. Alternatively, the depression 16 may also be extended through the body 10 such that the wrench can also be reached from either the front side or the rear side of the body 10.

It is to be noted that the thickness of the body 10 may be decreased from bottom to the top portion thereof, and the sizes of the openings 12 may be changed and decreased from the bottom to the top portion of the body 10 such that the sizes of the openings 12 are different in order to accommodate tools of different sizes.

Accordingly, the tool holder in accordance with the present invention includes a plurality of openings formed therein and extended through the whole thickness of the body such that the tools received in the openings can be reached from either the front side or the rear side of the body and such that the tools can be easily engaged within the openings of the body can be easily taken out from the body.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A holder for mounting a plurality of different-sized generally-cylindrical socket members therein, the socket members adapted for interchangeable coaction with a socket wrench, the holder comprising:

a body having opposite first and second planar surfaces;

a plurality of different-sized cavities formed through the body, with each of the cavities generally cubic in shape and each of the cavities having opposite margins, each of the cavities defining an opening in the first planar surface and an opening in the second planar surface, and each of the cavities corresponding in size to snugly receive one of the socket members therein;

each of the socket members removably retainable in its corresponding cavity;

the body including in each cavity pairs of lip projections extending from the opposite margins at both the first and the second planar surfaces with all of the lips extending into its respective cavity to retain its corresponding socket member therein;

each of the openings in the first planar surface and in the second planar surface sized to pass its corresponding socket member, whereby the socket members are removable from either its corresponding opening in the first planar surface or its corresponding opening in the second planar surface.

2. The holder as claimed in claim 1, wherein the body decreases in thickness from a bottom portion to a top portion thereof, sizes of the cavities decreasing from the bottom portion.

3. The holder as claimed in claim 2, wherein the body has a depression formed in the bottom portion thereof for removably retaining the socket wrench therein.

* * * * *